US008537148B2

(12) United States Patent
Yamauchi

(10) Patent No.: US 8,537,148 B2
(45) Date of Patent: Sep. 17, 2013

(54) IMAGE DISPLAY APPARATUS AND IMAGE DISPLAY METHOD

(75) Inventor: Himio Yamauchi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 759 days.

(21) Appl. No.: 12/720,521

(22) Filed: Mar. 9, 2010

(65) Prior Publication Data

US 2010/0283770 A1 Nov. 11, 2010

(30) Foreign Application Priority Data

May 8, 2009 (JP) ..... 2009-113572

(51) Int. Cl.
*G09G 5/00* (2006.01)

(52) U.S. Cl.
USPC ..... 345/207; 345/102; 345/690; 362/97.2

(58) Field of Classification Search
USPC .... 345/87, 89, 102, 204, 207, 690; 362/97.1, 362/97.2; 349/69, 70
See application file for complete search history.

(56) References Cited

U.S. PATENT DOCUMENTS

| | | | | |
|---|---|---|---|---|
| 7,375,733 | B2 * | 5/2008 | Ando | 345/690 |
| 8,022,902 | B2 * | 9/2011 | Lee | 345/76 |
| 2007/0171217 | A1 * | 7/2007 | Tsai et al. | 345/207 |
| 2007/0216636 | A1 * | 9/2007 | Lo | 345/102 |
| 2009/0122087 | A1 * | 5/2009 | Maruyama et al. | 345/690 |
| 2009/0278828 | A1 * | 11/2009 | Fletcher et al. | 345/207 |
| 2010/0225574 | A1 * | 9/2010 | Fujiwara et al. | 345/102 |

FOREIGN PATENT DOCUMENTS

| | | | |
|---|---|---|---|
| JP | 10-020277 | | 1/1998 |
| JP | 2000-124484 | | 4/2000 |
| JP | 2000-132138 | | 5/2000 |
| JP | 2002-99250 | A | 4/2002 |
| JP | 2004-272070 | | 9/2004 |
| JP | 2005-286735 | | 10/2005 |
| JP | 2007-065680 | | 3/2007 |
| JP | 2007-140436 | | 6/2007 |
| JP | 2007-219125 | A | 8/2007 |
| JP | 2008-268623 | A | 11/2008 |
| JP | 2008-292891 | A | 12/2008 |
| JP | 2009-085990 | | 4/2009 |
| WO | WO-2008/026576 | | 3/2008 |
| WO | WO-2009/096068 | | 8/2009 |

OTHER PUBLICATIONS

Japanese Office Action dated May 18, 2010, filed in Japanese counterpart Application No. 2009-113572, 7 pages (with English translation).

(Continued)

*Primary Examiner* — Tom Sheng
(74) *Attorney, Agent, or Firm* — Patterson & Sheridan, LLP

(57) ABSTRACT

According to one embodiment, an image display apparatus comprises a detector configured to detect an illuminance of surroundings, an upper and lower limit calculator configured to calculate an upper limit and a lower limit of luminance based on the detection result of the illuminance, a luminance calculator configured to calculate the luminance of each of light sources to display an image based on an input image signal in the range of the upper limit to the lower limit, a correction module configured to correct the input image signal based on the calculated luminance, a light emitter configured to emit light based on the calculated luminance, the light emitter includes the light sources, and a light modulator configured to display an image by modulating light from each of the light sources based on the corrected input image signal.

3 Claims, 7 Drawing Sheets

(56) References Cited

OTHER PUBLICATIONS

Japanese Office Action dated Jan. 18, 2011, filed in Japanese counterpart Application No. 2009-113572, 8 pages (with English translation).

Toshiba, "New Regza of "High Image Quality Just Needed" capable of automatic image quality adjustment and dubbing to a server, with 300 GB HDD and capable of recording one-segment broadcasting" [online], Apr. 9, 2008, [retrieved on Jan. 11, 2011], URL, http://av/watch/impress.co.jp/docs/20080409/toshiba.htm, 9 pages.

* cited by examiner

IMAGE DISPLAY APPARATUS AND IMAGE DISPLAY METHOD

CROSS-REFERENCE TO RELATED APPLICATIONS

This application is based upon and claims the benefit of priority from Japanese Patent Application No. 2009-113572, filed May 8, 2009, the entire contents of which are incorporated herein by reference.

BACKGROUND

1. Field

One embodiment of the invention relates to an image display apparatus and an image display method which display images by illuminating a liquid-crystal panel with backlighting.

2. Description of the Related Art

In recent years, liquid-crystal display devices have been used as image display means for television sets, personal computers, mobile phones, and the like. A liquid-crystal display device is composed of a liquid-crystal panel and a backlight provided on the rear of the liquid-crystal panel. Since the liquid-crystal panel emits no light, the backlight illuminates the liquid-crystal panel, thereby displaying an image.

Recently, there has been a strong demand toward an improvement in the quality of images displayed by the liquid-crystal display device and various techniques have been proposed. A liquid-crystal display device has been proposed which displays high-quality images with less energy by using the technique for separately controlling light sources (LEDs) constituting a backlight. As an example, Jpn. Pat. Appln. KOKAI Publication No. 2002-99250 (document 1) has disclosed a display apparatus which controls the luminance of each illumination region of the illumination unit on the basis of an input image signal. As another example, Jpn. Pat. Appln. KOKAI Publication No. 2007-219125 (document 2) has disclosed an electro-optical apparatus which detects the illuminance of ambient environment light and switches between the transmissive display mode and the reflective display mode according to the illuminance of the environment light.

As described above, various image quality improvement techniques have been proposed, but there is no end to demands for image quality improvement.

For example, the display apparatus disclosed in document 1 controls the luminance of each illumination region without taking the illuminance of the surroundings into account. Accordingly, in dark surroundings, the displayed image may be too bright or have too high a contrast. Conversely, in bright surroundings, the displayed image may be too dark or have too low a contrast. In addition, the display apparatus disclosed in document 1 controls the luminance of each illumination region without taking the attribute of the input image signal into account. Accordingly, for example, when an image based on the input image signal into which a film image has been converted is displayed, the displayed image is too bright or has too high a contrast, which makes it difficult to display the film image suitably.

Furthermore, the electro-optical apparatus disclosed in document 2 switches between the transmissive display mode and the reflective display mode according to the illuminance of the surroundings without taking the characteristic of the displayed image into account, which makes it difficult to display an image suitably.

BRIEF DESCRIPTION OF THE SEVERAL VIEWS OF THE DRAWINGS

A general architecture that implements the various features of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, an image display apparatus comprises a detector configured to detect an illuminance of surroundings, an upper and lower limit calculator configured to calculate an upper limit and a lower limit of luminance based on the detection result of the illuminance, a luminance calculator configured to calculate the luminance of each of light sources to display an image based on an input image signal in the range of the upper limit to the lower limit, a correction module configured to correct the input image signal based on the calculated luminance, a light emitter configured to emit light based on the calculated luminance, the light emitter comprising the light sources, and a light modulator configured to display an image by modulating light from each of the light sources based on the corrected input image signal.

Hereinafter, referring to the accompanying drawings, embodiments of the invention will be explained.

In the specification and claims, the term "calculate" may be used to broadly suggest: "to compute", "to estimate", "to determine by using mathematics", and "to determine by reasoning, evaluating, etc".

Figure 1:
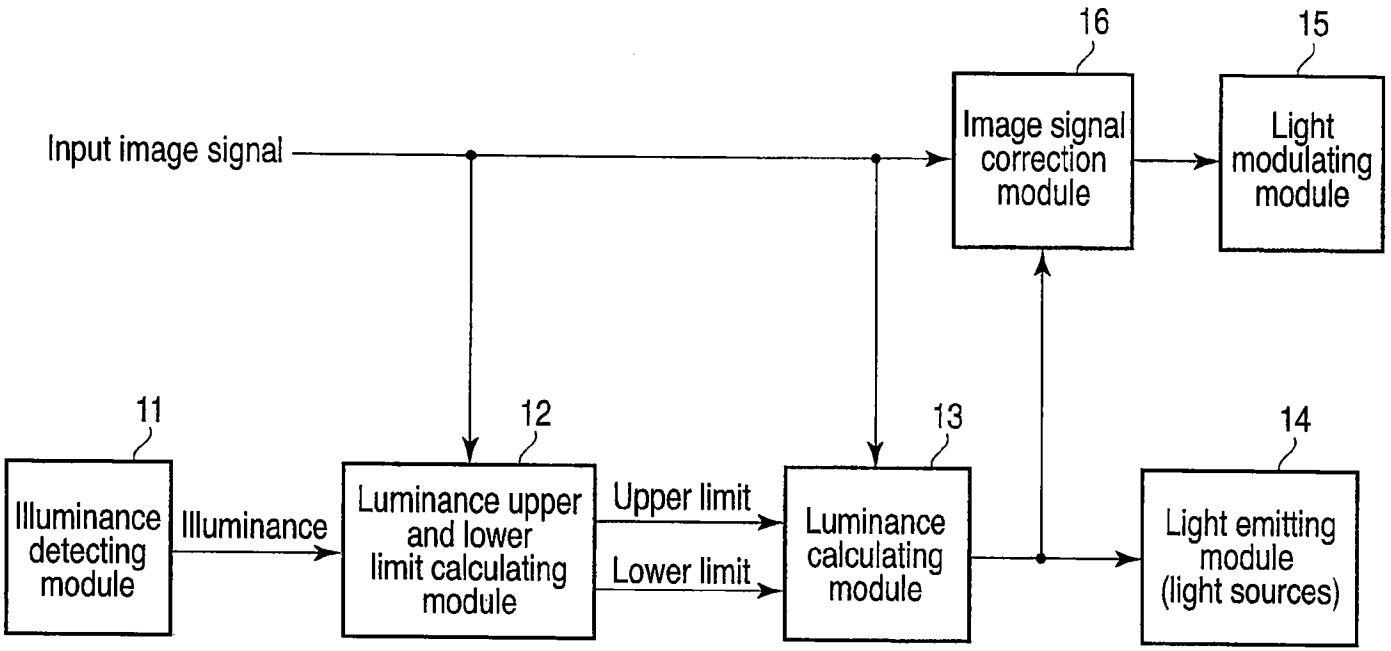
FIG. 1 is an exemplary block diagram showing a schematic configuration of a liquid-crystal display device according to a first embodiment of the invention.

FIG. 1 is an exemplary block diagram showing a schematic configuration of a liquid-crystal display device (or an image display apparatus) according to a first embodiment of the invention. As shown in FIG. 1, a liquid-crystal display device 100 comprises an illuminance detecting module (an illuminance detector) 11, a luminance upper and lower limit calculating module (a luminance upper and lower limit calculator) 12, a luminance calculating module (a luminance calculator) 13, a light emitting module (a light emitter) 14, a light modulating module (a light modulator) 15, and an image signal correction module 16.

The light emitting module 14 is composed of a lighting control unit and a backlight. The backlight is made up of light sources (e.g., LEDs). The lighting control unit controls the light emitting luminance of each light source on the basis of the luminance (or light source lighting value) of each light source computed by the luminance calculating module 13. The light modulating module 15 is composed of a liquid-crystal control unit and a liquid-crystal panel. The liquid-crystal control unit controls the modulation of light from each light source of the liquid-crystal panel on the basis of a correction image signal from the image signal correction module 16. That is, the liquid-crystal control unit controls the transmittance of the liquid-crystal panel. This causes the liquid-crystal panel to display an image on the basis of the correction input image signal. The liquid-crystal display device 100 matches the display timing of an image on the liquid-crystal panel with the lighting timing of each light source.

Figure 9:
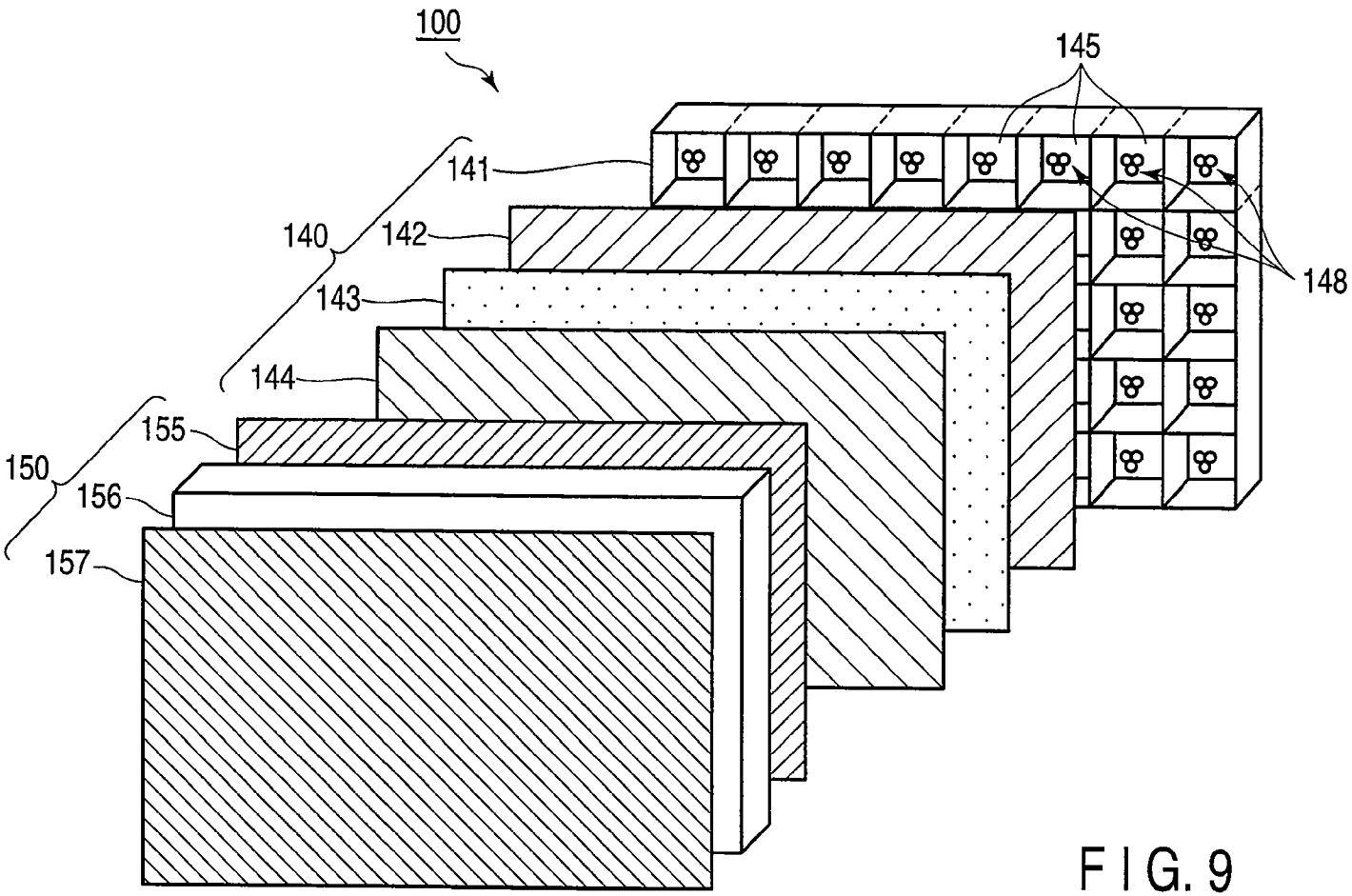
FIG. 9 is an exploded perspective view showing an example of a configuration of the backlight and liquid-crystal panel of the liquid-crystal display device shown in FIG. 1 or 2.
Figure 10:
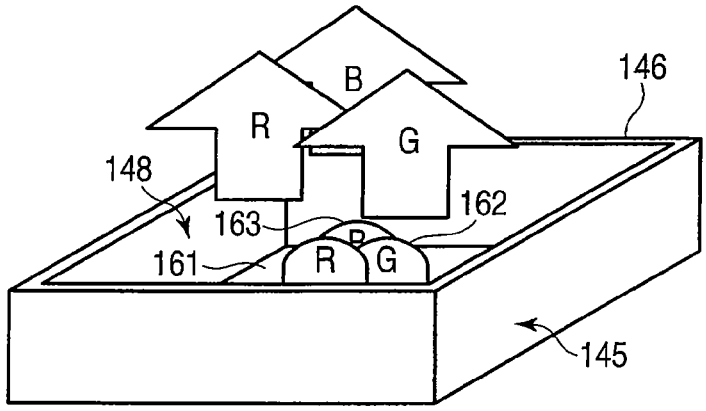
FIG. 10 is a perspective view showing an example of a configuration of a light source constituting a backlight shown in FIG. 9.

The backlight 140 and liquid-crystal panel 150 constituting the liquid-crystal display device 100 shown in FIGS. 1 and 2 will be explained in detail with reference to FIGS. 9 and 10. FIG. 9 is an exploded perspective view showing an example of a configuration of the backlight 140 and liquid-crystal panel 150 of the liquid-crystal display device 100. FIG. 10 is a perspective view showing an example of a configuration of a light source constituting the backlight 140.

The backlight 140 includes a light emitting unit 141, a pair of diffusing plates 142, 144 sandwiching a prism sheet 143 arranged in front of the light emitting unit 141. The light emitting unit 141, which is shaped like a panel, has a matrix structure. In the matrix structure, light-source regions 145 are arranged in M rows×N columns. FIG. 9 shows the light emitting unit 141 which includes, for example, 5 rows×8 columns of light-source regions 145.

As shown in FIG. 10, the light-source regions 145 are surrounded by confining walls 146 extending in the direction in which the walls 146 overlap with the diffusing plates 142 and others. In each of the light-source regions 145, a light source 148 composed of three LEDs 161, 162, 163 of RGB three primary colors is provided. The light source 148, which is made up of red LED 161, green LED 162, and blue LED 163, emits light forward (to the liquid-crystal panel 150), while mixing red, green, and blue light. The rear of the liquid-crystal panel 150 is illuminated with the outgoing light from each of the light-source regions 145. The passage of the outgoing light through the liquid-crystal panel 150 is adjusted, thereby displaying an image.

The liquid-crystal display device 100 is of an underlying type. In the underlying type, light sources 148 provided in each of the light-source regions 145 cause the entire surface of the backlight 140 to emit light, thereby illuminating the liquid-crystal panel 150 from behind. The liquid-crystal panel 150 includes a pair of deflecting plates 155, 157 and liquid crystal 156 sandwiched between the deflecting plates 155, 157.

To return to FIG. 1, the schematic configuration of the liquid-crystal display device will be explained. The luminance calculating module 13 calculates the luminance of each of the light sources from the input image signal in the spatial position corresponding to each light source, inputs the calculated luminance to each light source, and controls the luminance of each light source. For example, the maximum (or the maximum luminance) of the input image signal in the spatial position corresponding to each light source is found. The larger the maximum, the higher the luminance of the light source corresponding to the maximum is made. In this way, the contrast of the displayed image can be increased. The luminance calculating module 13 computes the luminance of the light source in the range of the upper limit to the lower limit calculated by the luminance upper and lower limit calculating module 12 explained later.

The image signal correction module 16 corrects the input image signal in the spatial position according to the luminance of each light source from the luminance calculating module 13. For example, the image signal correction module 16 finds the luminance of the light source corresponding to a certain pixel position from the luminance of each light source from the luminance calculating module 13. In addition, the image signal correction module 16 amplifies the signal level corresponding to the pixel position more as the luminance of the light source corresponding to the pixel position gets lower. In this way, the gradation of the displayed image can be made better. The output of the image signal correction module 16 is input to the light modulating module 15 (or liquid-crystal control unit).

Figure 3:
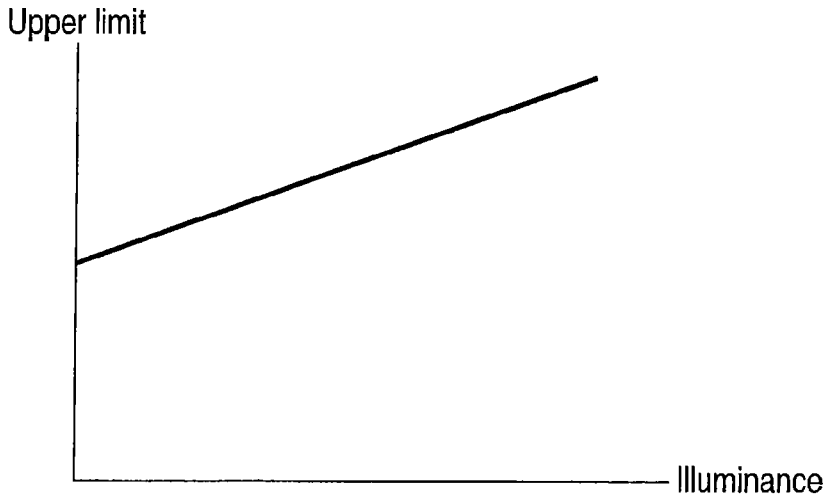
FIG. 3 is a diagram showing an example of setting the upper limit of the luminance of light sources on the basis of the illuminance of the surroundings.

The illuminance detecting module 11 detects the illuminance of the surroundings and inputs the detected illuminance to the luminance upper and lower limit calculating module 12. For example, if the illuminance of the surroundings is high (or the surroundings are bright), the luminance upper and lower limit calculating module 12 sets the upper limit of the luminance of light sources to a large value (FIG. 3). That is, the luminance upper and lower limit calculating module 12 computes a first upper limit on the basis of the detection of a first illuminance and, on the basis of the detection of a second illuminance higher than the first illuminance, computes a second upper limit larger than the first upper limit. This makes it possible to display a bright part of the input image so that the part may be brighter than the surroundings.

Figure 4:
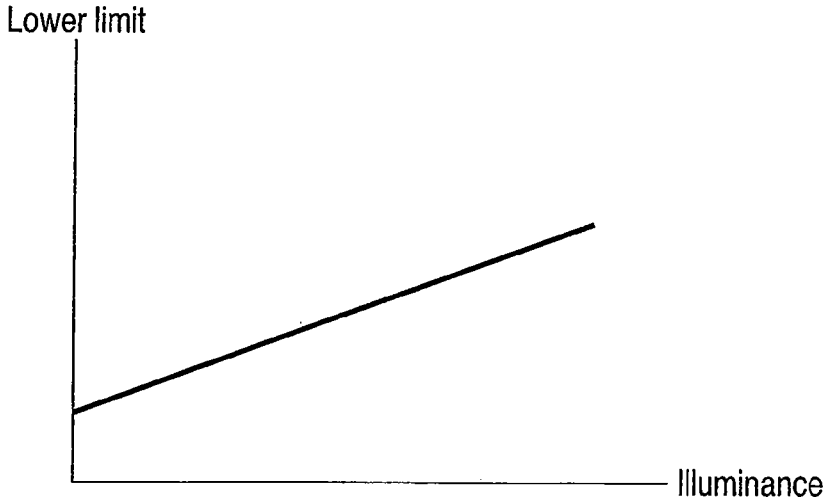
FIG. 4 is a diagram showing an example of setting the lower limit of the luminance of the light sources on the basis of the illuminance of the surroundings.

Alternatively, if the illuminance of the surroundings is high (or if the surroundings are bright), the luminance upper and lower limit calculating module 12 sets the lower limit of the luminance of light sources to a large value (FIG. 4). That is, the luminance upper and lower limit calculating module 12 computes a first lower limit on the basis of the detection of a first illuminance and, on the basis of the detection of a second illuminance higher than the first illuminance, computes a second lower limit larger than the first lower limit. This makes it possible to display a dark part of the input image suitably so that the part may not be blacked out (or so that the part may not get too dark) because of human visual characteristics.

If the illuminance of the surroundings is high (or if the surroundings are bright), the luminance upper and lower limit calculating module 12 may sets both the upper and lower limits of the luminance of light sources to large values.

Figure 5:
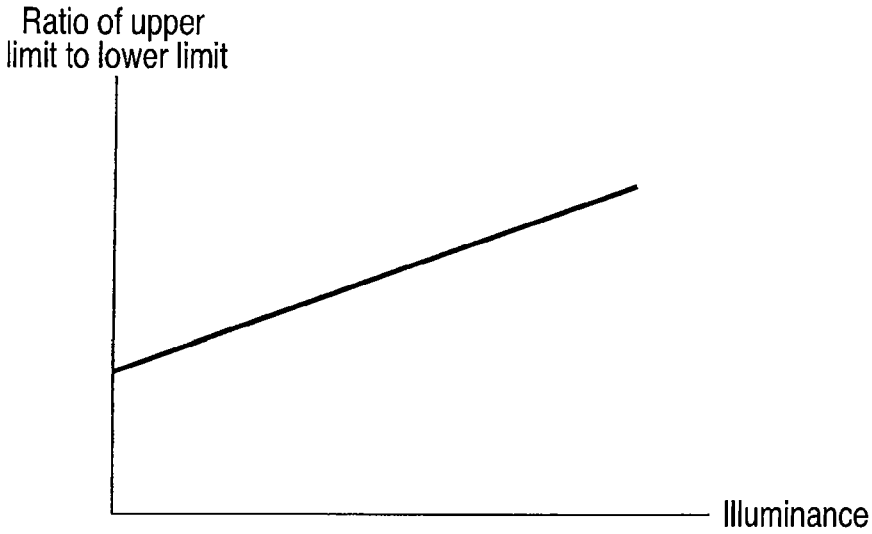
FIG. 5 is a diagram showing an example of setting the ratio of the upper limit to the lower limit of the luminance of the light sources on the basis of the illuminance of the surroundings.

As the ratio of the upper limit to the lower limit is higher, the contrast of the displayed image can be made higher. Therefore, if the illuminance of the surroundings is high (or if the surroundings are bright), the luminance upper and lower limit calculating module 12 increases the ratio of the upper limit to the lower limit (FIG. 5). That is, the luminance upper and lower limit calculating module 12 computes a first lower limit on the basis of the detection of the first illuminance and a first upper limit with a first ratio of the first upper limit to the first lower limit and then computes a second lower limit on the basis of the detection of a second illumination higher than the first illumination and a second upper limit with a second ratio of the second upper limit to the second lower limit higher than the first ratio. A method of increasing the ratio of the upper limit to the lower limit may be, for example, to set only the lower limit to a low value (second lower limit<first lower limit, first upper limit=second upper limit), or set only the upper limit to a high value (second lower limit=first lower limit, the first upper limit<second upper limit).

Alternatively, both the lower limit and upper limit may be changed to increase the ratio of the upper limit to the lower limit. This makes it possible to increase the contrast of the displayed image to display the image so as to prevent human visual characteristics from sensing that the contrast is low.

If the illuminance of the surroundings is low (or if the surroundings are dark), the luminance upper and lower limit calculating module 12 sets the upper limit of the luminance of light sources to a small value (FIG. 3). This makes it possible to decrease the brightness of the bright part of the input image to display the bright part so that the part may not be too bright.

Alternatively, if the illuminance of the surroundings is low (or if the surroundings are dark), the luminance upper and lower limit calculating module 12 sets the lower limit of the luminance of light sources to a small value (FIG. 4). This makes it possible to display the dark part of the input image so that the part may be darker.

In addition, if the illuminance of the surroundings is low (or if the surroundings are dark), the luminance upper and lower limit calculating module 12 may set the upper and lower limits of the luminance of light sources to small values.

Furthermore, as the ratio of the upper limit to the lower limit is lower, the contrast of the displayed image can be made lower. Therefore, if the illuminance of the surroundings is low (or if the surroundings are dark), the luminance upper and lower limit calculating module 12 decreases the ratio of the upper limit to the lower limit (FIG. 5). A method of decreasing the ratio of the upper limit to the lower limit may be, for example, to set only the lower limit to a high value, or set only the upper limit to a low value. Alternatively, both the lower limit and upper limit may be changed to decrease the ratio of the upper limit to the lower limit. This makes it possible to decrease the contrast of the displayed image to display the image so as to prevent human visual characteristics from sensing that the contrast is too high.

Figure 2:
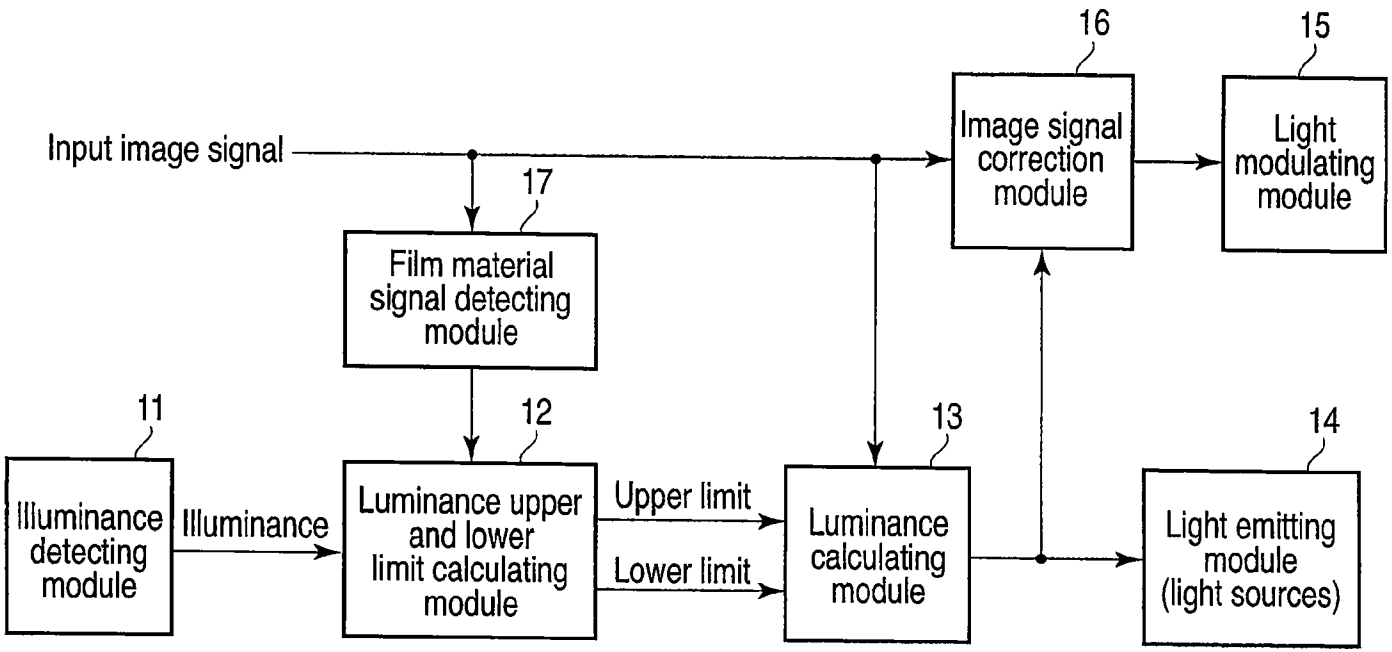
FIG. 2 is an exemplary block diagram showing a schematic configuration of a liquid-crystal display device according to a second embodiment of the invention.

FIG. 2 is an exemplary block diagram showing a schematic configuration of a liquid-crystal display device (an image display apparatus) according to a second embodiment of the invention. As shown in FIG. 2, the liquid-crystal display device 100 comprises an illuminance detecting module 11, a light modulating module 15, an image signal correction module 16, and a film material signal detecting module (a film material signal detector) 17. A big difference in configuration between the liquid-crystal display device 100 of FIG. 1 and the liquid-crystal display device 100 of FIG. 2 is that the liquid-crystal display device 100 of FIG. 2 includes the film material signal detecting module 17.

The film material signal detecting module 17, which is a module which detects the attribute of an input image signal, detects an attribute as to whether or not, for example, the input image signal is a signal (or a film image signal) generated from the images recorded on a moving picture film. One detecting method is such that the film material signal detecting module 17 detects whether or not the input image signal is a 2-3 pull-down signal, from the pattern of the movement of an input image signal from one frame to another. If having detected that the input image signal is a 2-3 pull-down signal, the film material signal detecting module 17 determines the attribute of the input image signal to be a film image signal and inputs the result of the determination of the film image signal to the luminance upper and lower limit calculating module 12.

Here, the 2-3 pull-down signal will be explained additionally. 2-3 pull-down is a method of converting (or pulling down) images recorded with 24 frames per second as in moving picture films into a video signal with 30 frames per second (or 60 fields per second) for TV broadcasting. For example, an odd-numbered frame of a moving picture film is converted into 2 fields or 3 fields and an even-numbered frame is converted into 3 fields or 2 fields. That is, an odd-numbered frame and an even-numbered frame of a moving picture film are converted into 5 fields. Consequently, 24 frames are converted into 60 fields. This makes it possible to convert images of a moving picture film into a video signal with 30 frames (60 fields) per second for TV broadcasting. That is, the 2-3 pull-down signal is an image signal generated for TV broadcasting from images recorded on a moving picture film.

Figure 6:
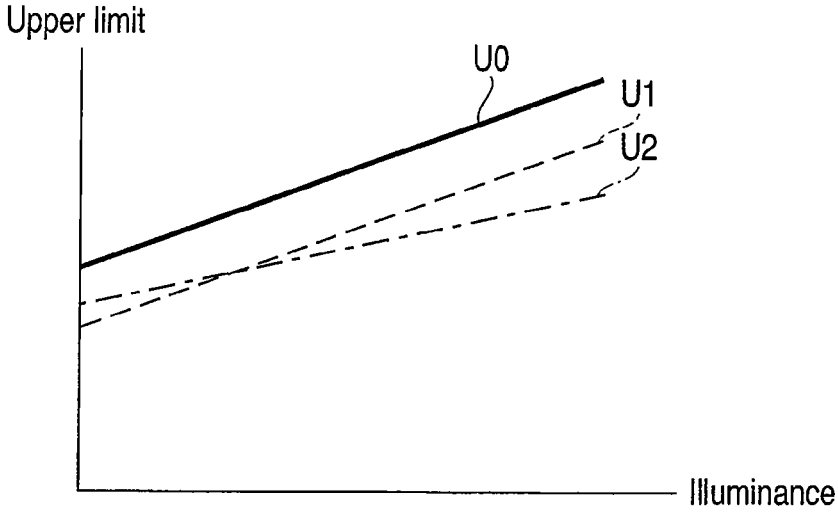
FIG. 6 is a diagram showing an example of setting the upper limit to deal with an input image signal corresponding to or not corresponding to a film image.

The luminance upper and lower limit calculating module 12 sets a first upper limit on the basis of a detected illuminance and the determination result showing that the input image signal is not a film image signal and further sets a second upper limit smaller than the first upper limit on the basis of the detected illuminance and the determination result showing that the input image signal is a film image signal (FIG. 6). As shown in FIG. 6, the upper limit U1 or upper limit U2 in a case where the input image signal is a film image signal may be set to the upper limit U0 in a case where the input image signal is not a film image signal. That is, the low upper limit U1 may be set to the upper limit U0 without exception. The upper limit U2 which decreases more as the illuminance gets higher may be set to the upper limit U0.

Figure 7:
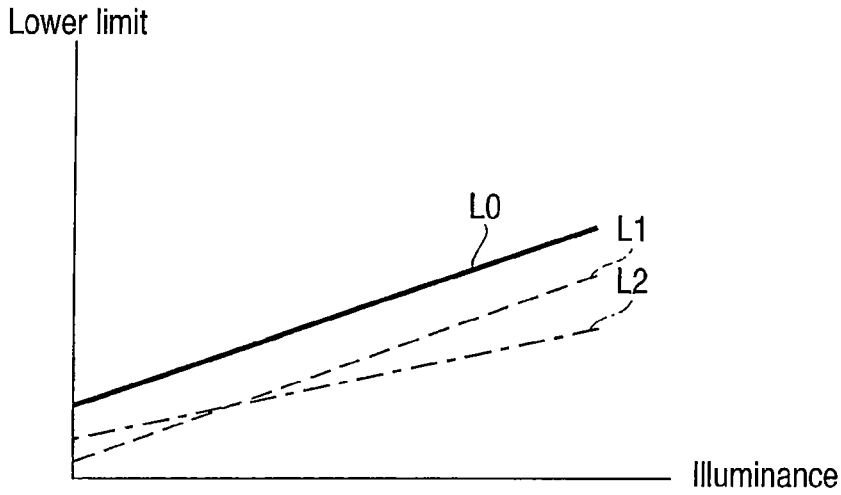
FIG. 7 is a diagram showing an example of setting the lower limit to deal with an input image signal corresponding to or not corresponding to a film image.

Alternatively, the luminance upper and lower limit calculating module 12 sets a first lower limit on the basis of a detected illuminance and the determination result showing that the input image signal is not a film image signal and further sets a second lower limit smaller than the first lower limit on the basis of the detected illuminance and the determination result showing that the input image signal is a film image signal (FIG. 7). As shown in FIG. 7, the lower limit L1 or lower limit L2 in a case where the input image signal is a film image signal may be set to the lower limit U0 in a case where the image signal is not a film image signal. That is, the low lower limit L1 may be set to the lower limit L0 without exception. The lower limit U2 which decreases more as the illuminance gets higher may be set to the lower limit L0.

Alternatively, the luminance upper and lower limit calculating module 12 sets a first upper limit and a first lower limit on the basis of a detected illuminance and the determination result showing that the input image signal is not a film image signal and further sets a second upper limit smaller than the first upper limit and a second lower limit smaller than the first lower limit on the basis of the detected illuminance and the determination result showing that the input image signal is a film image signal.

Figure 8:
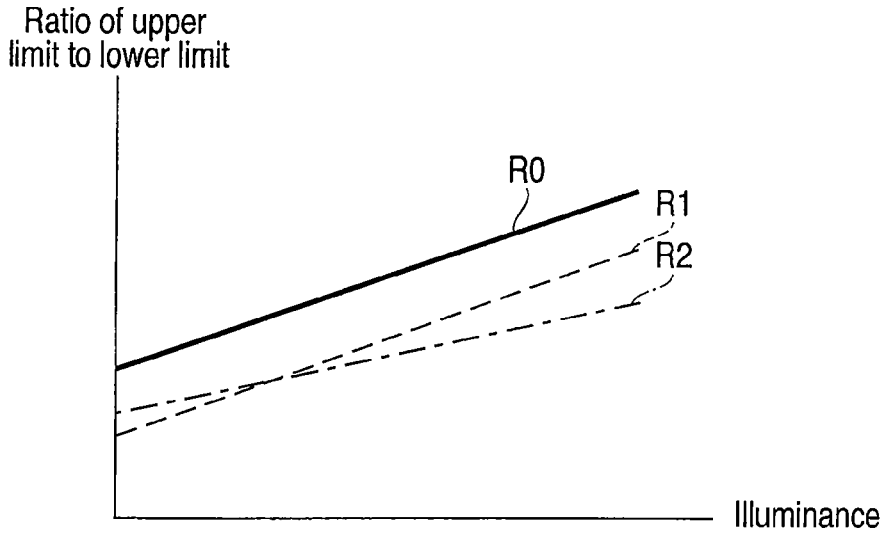
FIG. 8 is a diagram showing an example of setting a ratio of the upper limit to the lower limit to deal with an input image signal corresponding to not corresponding to a film image.

Alternatively, the luminance upper and lower limit calculating module 12 sets the ratio of the upper limit to the lower limit to a first ratio on the basis of a detected illuminance and the determination result showing that the input image signal is not a film image signal and further sets the ratio of the upper limit to the lower limit to a second ratio lower than the first ratio on the basis of the detected illuminance and the determination result showing that the input image signal is a film image signal (FIG. 8). A method of decreasing the ratio of the upper limit to the lower limit may be, for example, to set the lower limit to a high value or the upper limit to a low value. In addition, both the lower and upper limits may be changed to decrease the ratio of the upper limit to the lower limit. As shown in FIG. 8, ratio R1 or ratio R2 of the upper limit to the lower limit in a case where the input image signal is a film image signal may be set to ratio R0 of the upper limit to the lower limit in a case where the input image signal is not a film image signal. That is, low ratio R1 may be set to ratio R0 without exception, or R2 which decreases more as the illuminance gets higher may be set to ratio R0.

Accordingly, when the input image signal is a film image signal, an image whose brightness is decreased slightly can be displayed. This is because, when the input image signal is a film image signal, if an image is displayed with decreased brightness, the displayed image approaches an image displayed by a moving picture projector as compared with a case where the input image signal is not a film image signal. That is, viewers tend to like images displayed in this way.

The conventional liquid-crystal display device determines the luminance of light sources without taking the illuminance of the surroundings into account. Therefore, in dark surroundings, the displayed image is sometimes too high or sometimes has too high a contrast. Conversely, in bright surroundings, the displayed image is sometimes too dark or sometimes has too low a contrast. In addition, the conventional liquid-crystal display device determines the luminance of light sources without taking the attribute of the input image signal into account. For example, the conventional liquid-crystal display device determines the luminance of light sources, regardless of whether the input image signal is a film image signal. Accordingly, the displayed image is too bright or has too high a contrast, making it impossible to display the film image suitably.

In contrast, the liquid-crystal display device 100 of the second embodiment controls the luminance of each light source, taking the illuminance of the surroundings into account. Therefore, images can be displayed with brightness and contrast best suited to human visual characteristics. That is, images are not too bright or too dark and their contrast is not too high or too low, which enables the images to be displayed suitably. Furthermore, the liquid-crystal display device 100 of the second embodiment controls the luminance of each light source, taking into account whether the input image signal is a film image signal. Therefore, the film image can be displayed suitably.

The various modules of the device described herein can be implemented as software applications, hardware and/or software modules, or components on one or more computers, such as servers. While the various modules are illustrated separately, they may share some or all of the same underlying logic or code.

While certain embodiments of the invention have been described, these embodiments have been presented by way of example only, and are not intended to limit the scope of the inventions. Indeed, the novel method and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An image display apparatus comprising:

a detector configured to detect an illuminance of surroundings;

an attribute detector configured to detect an attribute of an input image signal;

an upper and lower limit calculator configured to calculate an upper limit and a lower limit of luminance based on the detected attribute and the detected illuminance, wherein the upper limit is a first upper limit when the detected attribute of the input image signal indicates that a signal is not converted from a film image and a second upper limit that is smaller than the first upper limit when the detected attribute of the input image signal indicates that a signal is converted from a film image;

a luminance calculator configured to calculate a luminance of each light source in a group of one or more light sources based on the input image signal, the luminance of each light source being in the range of the upper limit to the lower limit, a correction module configured to correct the input image signal based on the calculated luminance;

a light emitter configured to emit light based on the calculated luminance, the light emitter comprising the group of light sources; and a light modulator configured to display an image by modulating light from each of the light sources based on the corrected input image signal.

2. An image display apparatus comprising:

a detector configured to detect an illuminance of surroundings;

an attribute detector configured to detect an attribute of an input image signal;

an upper and lower limit calculator configured to calculate an upper limit and a lower limit of luminance based on the detected attribute and the detected illuminance, wherein the lower limit is a first lower limit when the detected attribute of the input image signal indicates that a signal is not converted from a film image and a second lower limit that is smaller than the first lower limit when the detected attribute of the input image signal indicates that a signal is converted from a film image;

a luminance calculator configured to calculate a luminance of each light source in a group of one or more light sources based on the input image signal, the luminance of each light source being in the range of the upper limit to the lower limit, a correction module configured to correct the input image signal based on the calculated luminance;

a light emitter configured to emit light based on the calculated luminance, the light emitter comprising the group of light sources; and a light modulator configured to display an image by modulating light from each of the light sources based on the corrected input image signal.

3. An image display apparatus comprising:

a detector configured to detect an illuminance of surroundings;

an attribute detector configured to detect an attribute of an input image signal;

an upper and lower limit calculator configured to calculate a ratio of an upper limit to lower limit of luminance based on the detected attribute and the detected illuminance, wherein the ratio is a first ratio of a first upper limit to a first lower limit when the detected attribute of the input image signal indicates that a signal is not converted from a film image and a second ratio of a second upper limit to a second lower limit when the detected attribute of the input image signal indicates that a signal is converted from a film image, the second ratio is lower than the first ratio;

a luminance calculator configured to calculate a luminance of each light source in a group of one or more light sources based on the input image signal, the luminance of each light source being in the range of the upper limit to the lower limit;

a correction module configured to correct the input image signal based on the calculated luminance;

a light emitter configured to emit light based on the calculated luminance, the light emitter comprising the group of light sources; and a light modulator configured to display an image by modulating light from each of the light sources based on the corrected input image signal.

* * * * *